United States Patent [19]

Satterwhite

[11] 3,997,990

[45] Dec. 21, 1976

[54] ANGULARLY DISPOSED SINGLE WHEEL EXCAVATOR

[75] Inventor: Charles R. Satterwhite, Dallas, Tex.

[73] Assignee: Unit Rig and Equipment Co., Tulsa, Okla.

[22] Filed: July 17, 1975

[21] Appl. No.: 596,575

Related U.S. Application Data

[63] Continuation-in-part of Ser. No. 435,296, Jan. 21, 1976, Pat. No. 3,896,571.

[52] U.S. Cl. ..... 37/189; 299/73; 37/91

[51] Int. Cl.[2] ..... E02F 3/24

[58] Field of Search ..... 37/189, 190, 94–97, 37/86–87, 91, DIG. 2, DIG. 16, DIG. 18; 299/74–78, 71, 73, 6; 307/9; 180/65 R, 65 P

[56] References Cited

UNITED STATES PATENTS

| | | | |
|---|---|---|---|
| 853,985 | 5/1907 | Linga | 37/94 |
| 1,346,679 | 7/1920 | Pratt | 37/190 B |
| 1,482,904 | 2/1924 | Moore et al. | 37/97 |
| 1,858,327 | 5/1932 | Hays | 37/190 X |
| 2,695,164 | 11/1954 | Arentzen | 299/71 |
| 3,121,558 | 2/1964 | Gonski et al. | 299/73 X |
| 3,157,437 | 11/1964 | Gonski | 299/73 X |
| 3,290,096 | 12/1960 | Stalker | 299/78 |
| 3,341,254 | 9/1967 | Arndt | 299/71 X |
| 3,469,885 | 9/1969 | Marberg | 299/71 |
| 3,612,610 | 1/1970 | Arentzen | 299/71 |

FOREIGN PATENTS OR APPLICATIONS

| | | | |
|---|---|---|---|
| 722,876 | 9/1931 | France | 37/190 B |
| 632,711 | 6/1936 | Germany | 37/96 |
| 258,133 | 12/1970 | U.S.S.R. | 37/97 |

*Primary Examiner*—E. H. Eickholt
*Attorney, Agent, or Firm*—Richards, Harris and Medlock

[57] ABSTRACT

An excavating and loading system includes an excavating wheel assembly at the front thereof and a plurality of conveyors for conveying the material from the excavating wheel assembly upward and rearwardly. The excavating wheel assembly includes at least one excavating wheel which is angularly disposed with respect to the direction of travel to form an excavation and has digging surfaces on the forward extending end of the excavating wheel. The wheel forms an excavation wider than the following portion of the system. A supporting and housing apparatus rotatably supports the excavating wheel means from the vehicle. Apparatus is provided for raising, lowering and/or tilting the supporting and housing apparatus to position the excavation wheel assembly to thereby vary the excavation. The excavation wheel is provided with means for positively moving the walls of a plurality of buckets between material receiving and material discharging positions.

20 Claims, 7 Drawing Figures

ANGULARLY DISPOSED SINGLE WHEEL EXCAVATOR

CROSS REFERENCE TO RELATED APPLICATION

This application is a Continuation-in-Part of copending application, Ser. No. 435,296, filed Jan. 21, 1974, for MULTI-WHEELED EXCAVATOR AND CONVEYING SYSTEM, now Pat. No. 3,896,571, granted July 29, 1975.

BACKGROUND AND SUMMARY OF THE INVENTION

The present invention relates to improvements in excavating and loading systems which form an excavation of a sufficient width to allow the following portion of the system to move through the excavation.

In large excavating and loading systems, for example, of the type capable of loading 4,000 cu. yds. of earth per hour, it has heretofore been known to utilize a system which forms a trench in the ground of a sufficient width to allow the system to move through the trench behind the excavating portion of the system. However, although various examples of such excavating and loading systems have been designed previously, the need persists for considerable improvement in the art.

In accordance with the broader aspects of the present invention, an improved excavating and loading system is disclosed including a vehicle and an excavating wheel assembly supported at the front of the vehicle. The excavating wheel assembly is disposed at an angle with respect to the direction of travel of the vehicle and has digging blades on the forward end thereof whereby an excavation is formed that is wider than the following portion of the system. Supporting and housing apparatus is mounted on the front of the vehicle and extends to support the excavating wheel assembly.

In accordance with the preferred embodiment of the of the present invention, an improved excavating and loading system is disclosed having a vehicle which comprises a main frame which is supported from the ground surface by driven wheels. A subframe is pivotally supported from the main frame so that the front end of the subframe can be vertically raised and lowered with respect to the main frame. Supporting and housing apparatus rotatably supports an excavating wheel assembly at the front of the vehicle in a position angularly disposed with respect to the direction of travel of the vehicle. A supporting and housing apparatus has a portion which engages the rearwardly facing end of the excavating wheel means to support the same from the front of the vehicle. Digging blades are formed on the forwardly facing end of the excavating wheel assembly. A blade and a bearing plate are connected to the lower portion of the main and subframes for stabilizing the excavating wheel assembly. The excavating wheel assembly includes a plurality of digging buckets each including a wall which is supported for pivotal movement between a material receiving position and a material discharging position. Structure is provided for rotating the excavating wheel assembly and for operation of the movable wall of the bucket to first receive material and to subsequently discharge the material onto a conveyor supported from the vehicle. A main conveyor conveys material upward and rearward. An auxiliary conveyor with inner and outer portions can be provided on the rear of the vehicle for receiving material from the main conveyor and for transporting material rearwardly and/or laterally.

DESCRIPTION OF THE DRAWINGS

A more complete understanding of the present invention can be had by referring to the following Detailed Description when taken in conjunction with the accompanying Drawings wherein.

DETAILED DESCRIPTION

Figure 1:
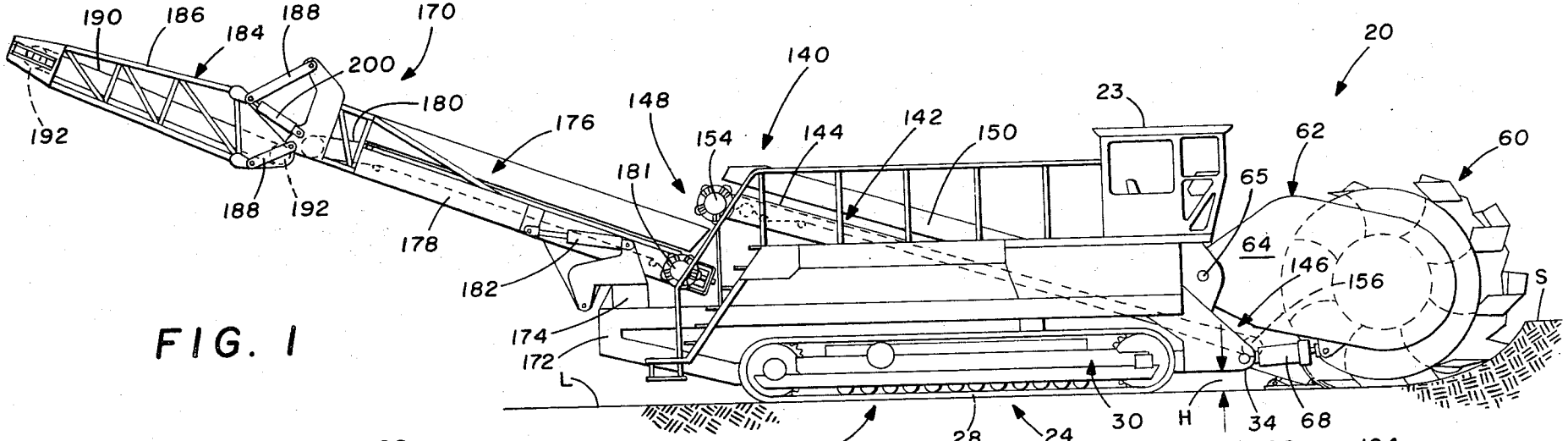
FIG. 1 is a side elevational of an excavating and loading system comprising the present invention.

Referring now to the Drawings, and particularly to FIG. 1, an excavating and loading system 20 incorporating the invention is shown. The system 20 comprises a vehicle 22 with an operator cab 23 and track type wheels 24 for movement along the surface. Each of the wheels 24 comprises an endless track 28 whereby the excavating and loading system 20 is adapted for movement over highways and other paved surfaces as well as for operation in unpaved areas, such as during excavating operations. As will be apparent to those skilled in the art, the vehicle 22 could be provided with other types of wheels and frames such as are well-known in the art, and in particular the vehicle could be supported and driven by rubber tires.

In accordance with the illustrated embodiment of the invention, an engine (not shown) is supported on the frame 30. The engine is preferably of the internal combustion type and functions in one embodiment to drive a plurality of hydraulic pumps. The hydraulic pumps in turn supply operating power through suitable controls in cab 23 to the various components of the excavating and loading system 20. For example, one of the pumps supplies operating power for a hydrostatic drive, which is in turn coupled to a transmission. The transmission in turn provides driving power for the wheels 24 to propel the excavating and loading system 20 during excavating operations and during travel. In an alternative embodiment, the engine drives an electrical generator which in turn supplies operating power to the system.

An excavating wheel assembly 60 is positioned on the forward portion of the vehicle 22. The excavating wheel assembly 60 includes a supporting and housing means 62 extending from the front of the frame 30. The supporting and housing means 62 comprises an end plate assembly 64 which is pivotally connected to the frame 30 by a shaft 65. A bifurcated portion 66 is formed on the front 34 of the frame 30. Concentric bores are formed in the portion 66 to support the shaft 65. Suitable bearing means are provided to allow rotation of the supporting and housing means 62 about the shaft 65. It is to be noted that the center line of the shaft 65 is offset an acute angle X to the direction of travel 69 of the vehicle. Although it is to be understood, of course, that the offset could have different angles in the present embodiment, the angle is about 12°.

A flange 67 extends from the front end of the main frame 30. A double-acting hydraulic cylinder assembly 68 is pivotally connected between the flange 67 and a flange on the end plate assembly 64. Thus, by selectively manipulating controls provided in cab 23 to supply hydraulic fluid under pressure to the cylinder 68, the effective length of the cylinder 68 can be varied to selectively control a rotation of the excavating assembly 60 about the shaft 65. In this manner, the relative height of the excavating wheel assembly 60 with respect to the frame 30 of the vehicle can be adjusted as desired.

Figure 3:
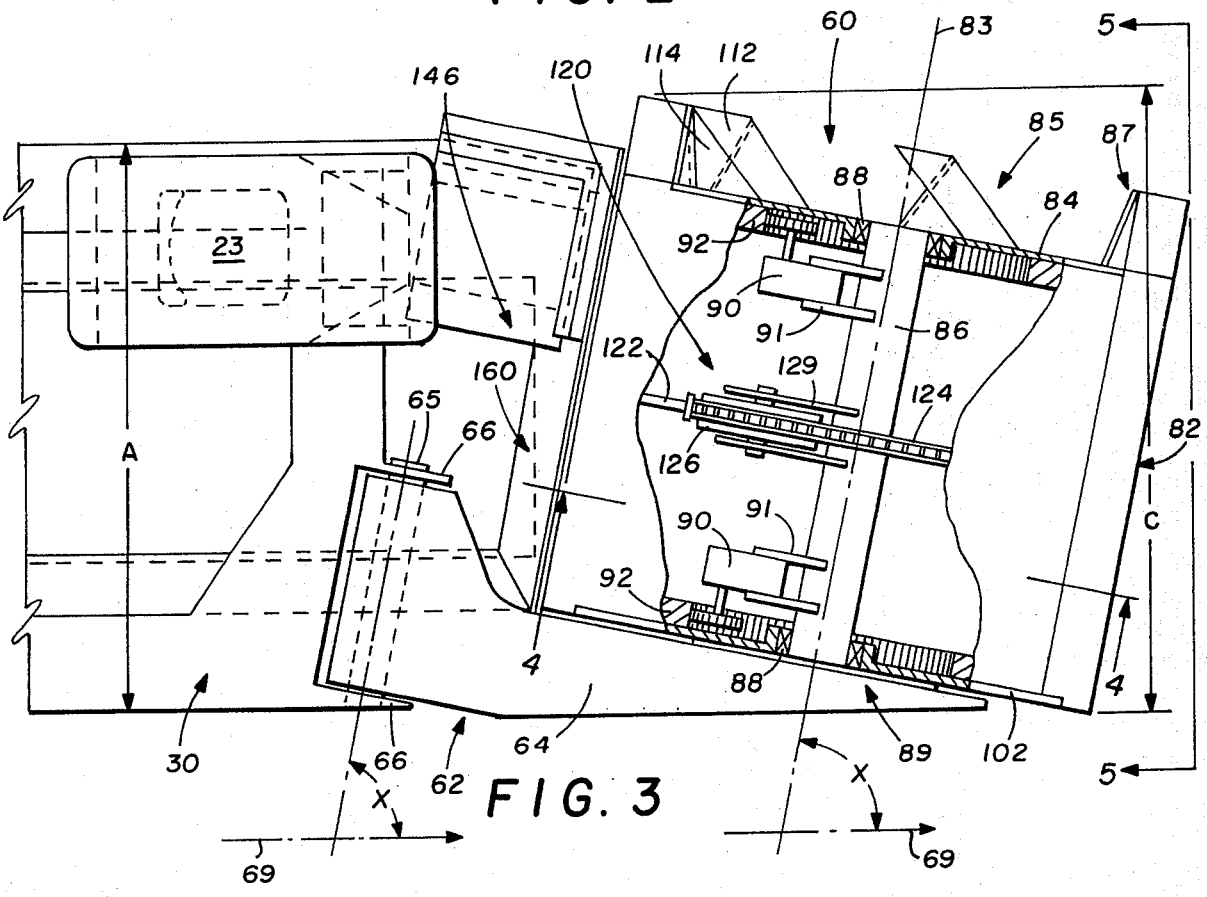
FIG. 3 is a partial enlarged plan view of the front portion of the excavating and loading system illustrated in FIG. 1.
Figure 5:
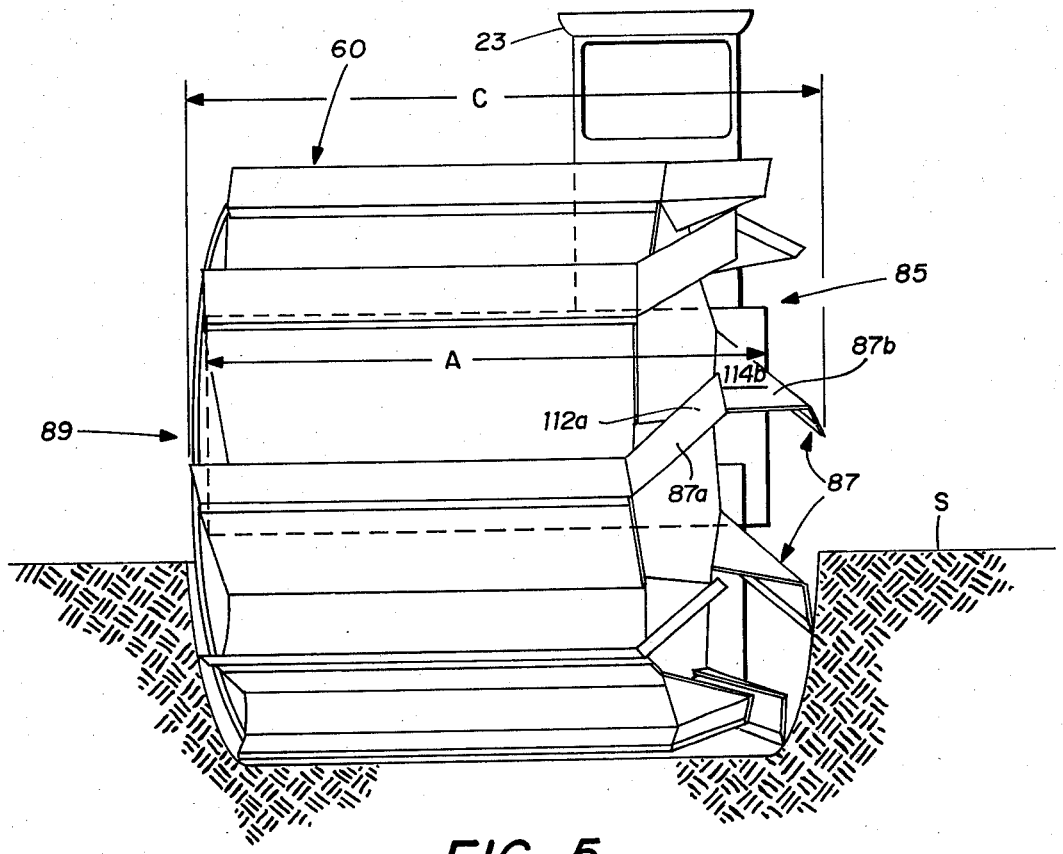
FIG. 5 is a sectional view taken on line 5—5 of FIG. 3, looking in the direction of the arrows.

The excavating wheel assembly 60 further comprises at least one excavating wheel 82 supported from the housing means 62 for rotation about a horizontally-extending axis 83. Excavation wheel 82 includes a pair of rims 84 which extend radially outward along the sides of the wheel. Rims 84 define the overall width of the wheel 82. Horizontally-extending axis 83 intersects the direction of travel 69 at angle X as illustrated in FIG. 3. In this manner, the wheel 82 has a forwardly-facing end 85 on which digging teeth 87 are provided. As can be seen in FIGS. 3 and 5, by inclining the axis of the wheel 82 with respect to the direction of travel 69, the wheel 82 will form an excavation with a width C. The distance C is the excavation width of the excavating wheel 82 in the position illustrated. In the embodiment illustrated, the width C is greater than the width of the following portion of the vehicle A.

A shaft 86 extends from plate assembly 64, in a horizontal direction. Each of the rims 84 is rotatably supported from the shaft 86 by bearings 88. The plate assembly 64 extends to the rearwardly-facing end 89 of the wheel 82.

Figure 2:
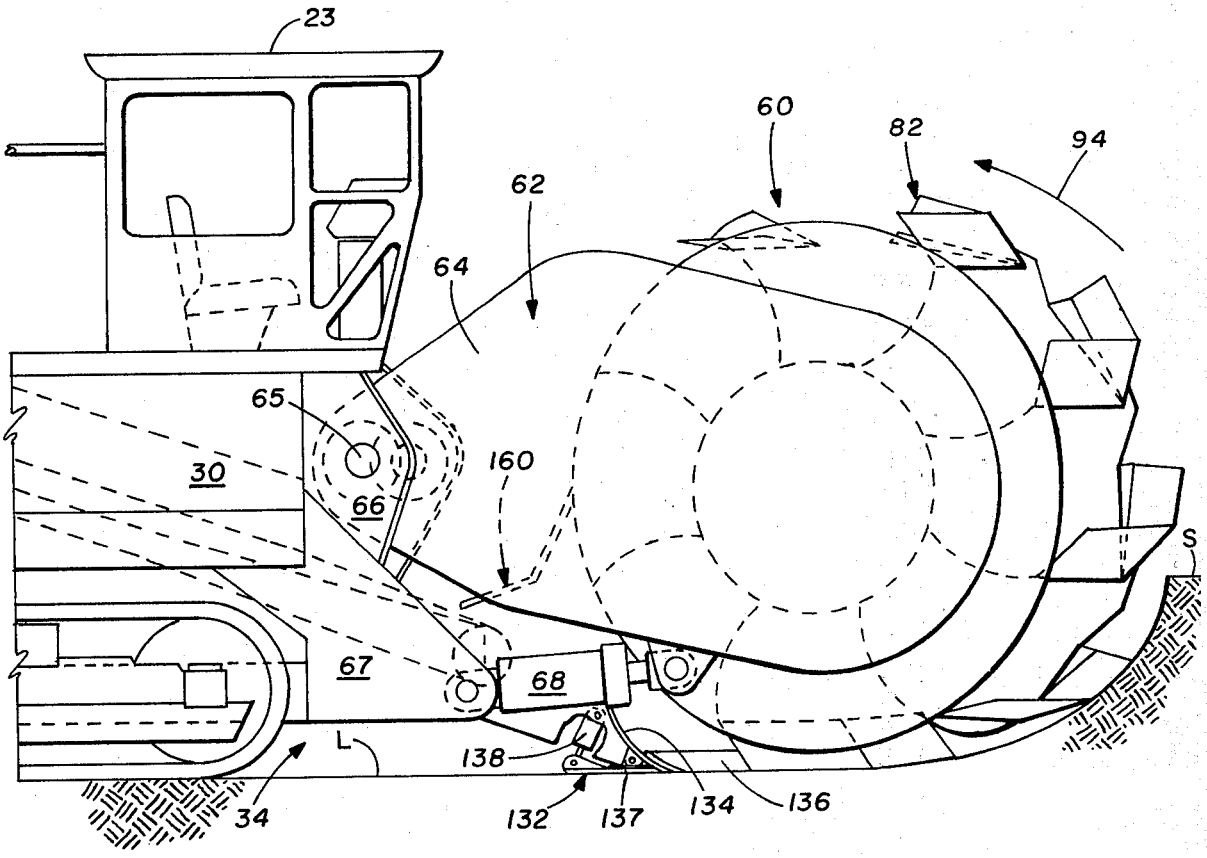
FIG. 2 is a partial enlarged side elevation of the front portion of the excavating and loading system illustrated in FIG. 1.

In one embodiment, a pair of hydraulic motors 90 is positioned inside the wheel 82 and each is supported from flanges 91 in a fixed angular position relative to shaft 86. It is to be understood that one or more than two motors 90 could be used. A pair of internal ring gears 92 is likewise positioned inside the wheel 82 adjacent to the rims 84. Each of the motors 90 is provided with an output sprocket which engages one of the two ring gears 92 mounted inside wheel 82 to drive wheel 82 to rotate in the direction of arrow 94 as shown in FIG. 2. Hydraulic lines communicating with the motors 90 extend through the end plate assembly 64.

Figure 4:
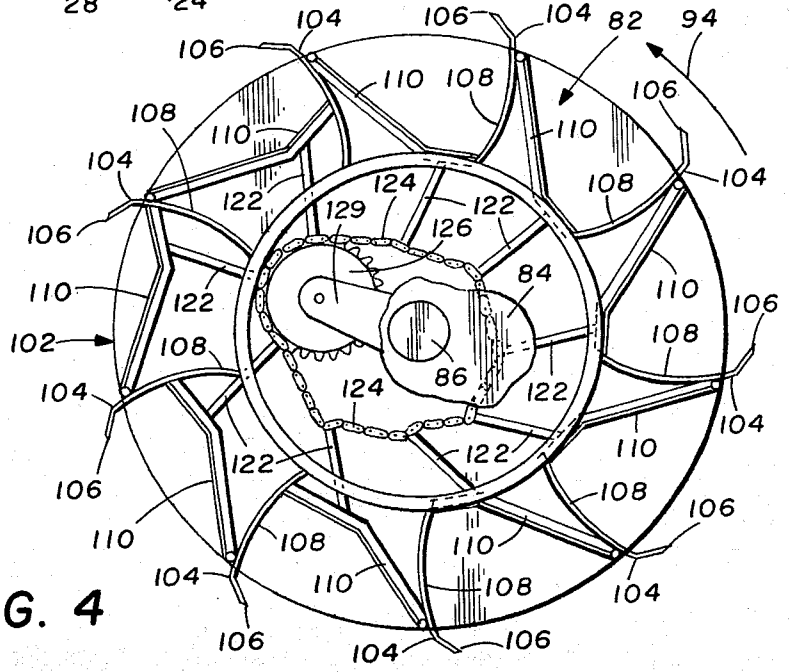
FIG. 4 is a side elevation partly in section of the system for actuating the rear plates of the digging buckets of the excavating and loading system incorporating the present invention.

As shown in FIG. 4, the wheel 82 further comprises a plurality of digging buckets 102 which are equally spaced circumferentially around the wheel 82 and extend between the rims 84. The digging buckets 102 each have a cutting edge 104, including a plurality of teeth 106 and a stationary wall 108, extending generally radially inward from the cutting edge 104. Each digging bucket further includes a rear wall 110, which is supported for pivotal movement between a digging position and a dumping position.

Figure 6:
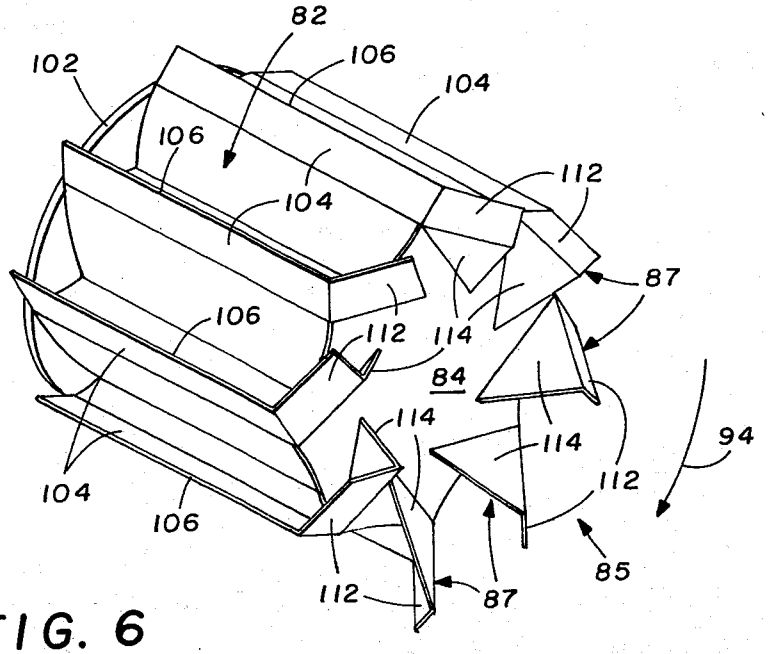
FIG. 6 is a perspective of the forward facing side of the digging wheel of FIG. 3, looking in the direction of the arrows.

The operation of the rear wall 110 is best illustrated in FIG. 4, wherein the wall is shown manipulated between a digging position where the respective buckets 102 are in the lower and forward positions of their rotary motion and a dumping position where the respective buckets are in the upper and rearward positions of their rotary motion. As can best be seen in FIGS. 3 and 6, the forwardly facing end 85 of the wheel 82 has a plurality of digging teeth 87 thereon. These digging teeth 87 cooperate with the buckets 102 during the digging operation. The teeth 87 each comprise a plate 112 which extends from the upper portion of each of the fixed walls 104. These plates 112 extend in the forward direction of rotation of the wheel 82 to guide materials into the bucket 102. A gusset plate 114 extends from each of the plate 112 to the rim 84. The gusset plate 114 and plate 112 form a scoop for excavating materials in front of the wheel 82 and for guiding the materials into the digging buckets 102.

Referring particularly to FIGS. 3 and 4, an actuating system 120 for the digging buckets 102 is shown. The system 120 is located completely within the margins of the wheel 82 and comprises a plurality of push rods 122, each of which is connected between one of the rear walls 110 and a chain 124. The chain 124 is generally unconstrained, but extends around a roller 126 which is supported on shaft 86 by brackets 129. The roller 126 is sprocketed on the outer periphery to engage the chain 124. As the excavating wheel 82 is rotated about the shaft 86 under the actions of motors 90, each push rod 122 comes into engagement with the roller 126 whereupon its respective rear wall 110 is pushed outwardly into the material dumping position. Subsequently, as each digging bucket 102 is rotated to the lower and forward portion of the circular path, the chain 124 operates through push rods 122 to positively return the rear wall 110 to the material digging position. This positive action of the rear wall 110 in both directions has been found to be vastly superior to the arrangements that have been used heretofore wherein the rear portions were allowed to return to the digging position under the action of gravity and/or the crowding of excavated material into the buckets 102. It is envisioned, of course, that other positive acting actuating systems could be used, such as those described in the earlier copending application, Ser. No. 435,296, now U.S. Pat. No. 3,896,571, the disclosure of which is incorporated herein by reference.

Positioned below and behind the excavating wheel 82 is a moldboard assembly 132. This moldboard assembly extends completely across the width of the wheel 82 and is provided to pick up loose material and crowd material in a forward direction as the excavating and loading system moves. The assembly 132 comprises a plate 134 which is curved to conform to the path of travel of the edges 104. A blade 136 is positioned adjacent the lower edge of the plate 134. The plate 134 is rigidly supported from the housing means 62. A bearing plate 137 is pivotally supported at its leading edge from the seat of plate 134. Selectively operable double-acting hydraulic cylinder means 138 are pivotally attached between the trailing edge of the bearing plate 137 and the plate 134.

Thus, by manipulating control means provided in the cab 23, the effective length of the hydraulic cylinder means 138 can be selectively varied to appropriately position the bearing plate 137 with repsect to the housing means 62 as desired. This bearing plate 137 can be adjusted to set the vertical pressure of the plate to reduce bouncing and stabilize the excavating system 20.

As is illustrated in FIGS. 1 and 2, the excavating system 20 further includes a loading system 140. The loading system 140 includes a main conveyor 142 comprising an endless belt 144 mounted for movement around a course extending angularly upwardly relative to the frame 30 of the vehicle 22 and including a lower material receiving portion 146 and an upper material delivery portion 148. More particularly, the course of the belt 144 is defined by a plurality of rollers (not shown) which are supported on a conveyor frame 150. The conveyor frame 150 is supported on the frame 30 of the vehicle 22 and includes means supporting the delivery portion 148 for pivotal movement about a horizontal axis under the action of the hydraulic cylinder (not shown). This permits control of the vertical height and allows folding of the material delivery portion 148 of the conveyor 142.

Belt 144 of the main conveyor 142 extends around a drum mounted at the upper end of the frame 150 and around a drum 156 mounted on the frame 30. The upper drum is rotated by a radial hydraulic motor 154 and the lower drum 156 is rotated by similar motor (not shown). By this means, the belt 144 is moved around the course defined by the rollers to move material from the material receiving portion 146 to the material discharge or delivery portion 148.

A chute 160 is supported from the frame 30 behind and below the excavating wheel 82 to receive material discharged from the buckets 102. The chute 160 is shaped to direct the material onto the material receiving portion 146 of the main conveyor 142. This chute 160 transports material excavated by the excavating wheel 82 onto the main conveyor 142 for transportation thereby from the material receiving portion 146 to the material delivery portion 148.

Referring now particularly to FIG. 1, the disclosed embodiment of the invention further includes an auxiliary conveyor system 170. The auxiliary conveyor system 170 includes a frame 172 which is secured to the rear end of the frame 30 of the vehicle 22. A turntable 174 is supported on the frame 172 for pivotal movement about a vertical axis under the action of hydraulic motor (not shown).

An inner conveyor 176 is supported on the turntable 174 to receive material discharged from the material delivery portion 148 of the main conveyor 142. The conveyor 176 comprises a frame 178 which is supported on the turntable 174 and an endless belt 180 mounted for movement around the course defined by a plurality of rollers. The belt 180 is driven by a radial hydraulic motor 181, and a hydraulic cylinder 182 is provided for controlling the angular relationship of the frame 178 to the turntable 174.

The auxiliary conveyor system 170 further includes an outer conveyor 184 comprising a frame 186 which is supported from frame 178 by upper and lower parallel links 188. An endless belt 190 is supported on the frame 186 for movement around a course defined by a pair of drums 192. The outer conveyor 184 is driven by small hydraulic motors (not shown) mounted in the drums 192.

A hydraulic cylinder 200 is pivotally connected between the frames 178 and 186 to manipulate the outer conveyor 184 with respect to the inner conveyor 176. In this manner, the outer conveyor 184 may be manipulated to selectively receive material from the inner conveyor 176.

In operation, the excavation and loading system 20 incorporated in the present invention, will be moved to the site by means of wheels 24. Hydraulic cylinder 68 will be adjusted as desired so that the excavating wheel assembly 60 will excavate at the desired depth. Moldboard assembly 132 will be adjusted at the desired position by operation of the hydraulic cylinder 138. Thereafter, the excavating wheel 82 can be rotated to excavate material from in front of the vehicle 22. As is illustrated in FIG. 5, this excavation area will have a width C greater than the width of the excavating wheel 82. This is due to the inclined position of the wheel 82 and the digging teeth 87 in the forward facing end 85.

In addition, it it important to appreciate as is illustrated in FIG. 5, that the path of travel of the teeth 87 completely excavates the area in front of the forward facing end 85 of the wheel 82. This is accomplished because the outer portion of each tooth 87 in the forward position will extend to overlap the inner portion of the tooth in the rear position. In FIG. 5, tooth 87*a* is illustrative of the forward position while tooth 87*b* is illustrative of the rear position. As can be seen, the outer portion of the plate 112*a* of tooth 87*a* will overlap the forward projection of the inner portion of the plate 114*b*. This overlapping provides complete excavation from in front of the forward facing end 85. As will be appreciated by those of ordinary skill in the art, the width C is wider than the width A of the following portion of the excavating and loading system 20, and thus, the excavating and loading system 20 can move through the excavation formed by the wheel 82. It will also be appreciated by those of ordinary skill in the art, that the supporting and housing means is positioned completely behind the wheel 82 and engages and supports the wheel 82 from the rearward facing end 89.

It is to be understood, of course, that the bifurcated portion 66 could be positioned to extend from the ends of the excavating wheel 82 at a height higher than the center of rotation of the wheel 82. In this manner, the wheel 82 could be utilized to excavate at depths equal to or even greater than the radius of the wheel 82 itself.

Figure 7:
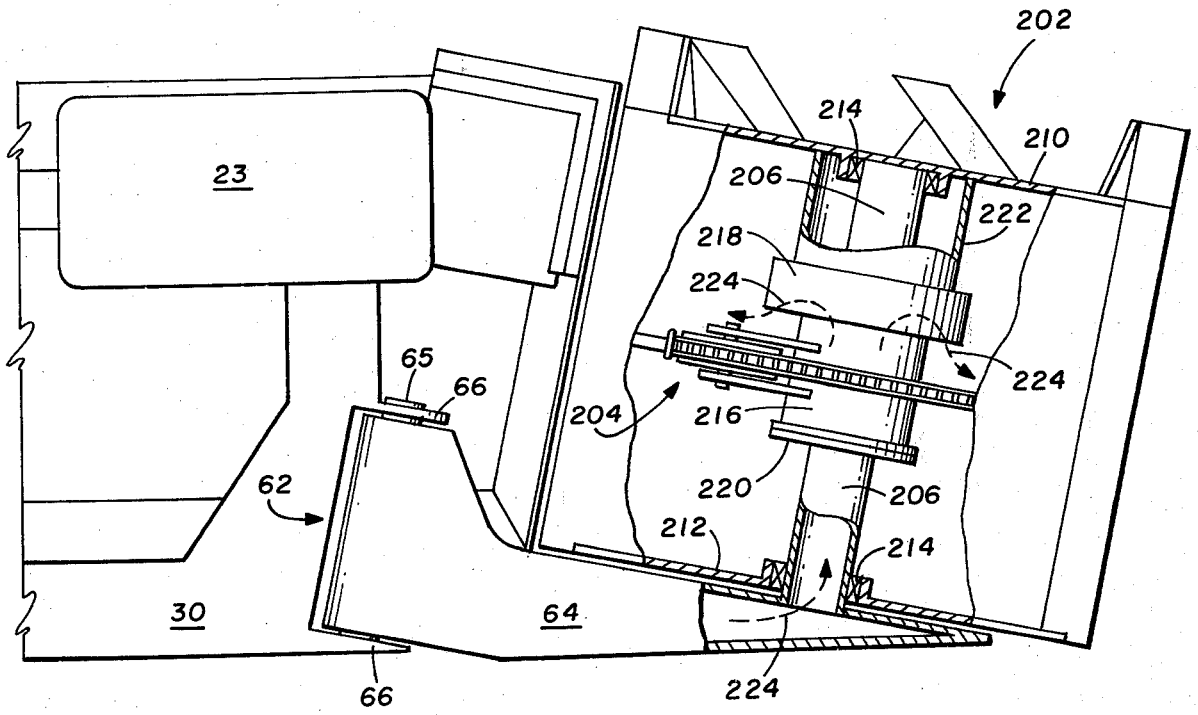
FIG. 7 is a sectional view similar to FIG. 3 of an alternate embodiment of its excavating wheel assembly.

In FIG. 7 an alternate configuration of the excavating wheel assembly is illustrated. The second embodiment of the excavating wheel assembly 202 is carried by the supporting and housing apparatus 62. The excavating wheel assembly 202 comprises a plurality of digging buckets, not shown, which are identical in construction to the digging 102 on the wheel 82. In addition, a bucket actuation system 204 is provided for moving the walls of the digging buckets 102. This system 204 is identical in construction to the bucket actuation system illustrated in FIGS. 3 and 4 and described above.

The wheel 202 is identical to the wheel 82 in all aspects except the driving means. The wheel 202 illustrated in FIG. 7 is driven by an electrically powered system. In this embodiment, it is to be understood, of course, that the excavating and loading system 20 is provided with a motor-generated assembly for providing electrical power for the wheel 202.

As can be seen in FIG. 7, the wheel 202 is supported from a shaft 206 which extends from the assembly 64. This shaft 206 is hollow for reasons which will be pointed out hereinafter. The wheel 202 has a rim 210 which is rotatably supported from the shaft 206 by bearings 214.

A direct current electric motor 216 and a planetary gearbox reducer 218 are positioned inside the wheel 202 and are suppported on the shaft 206. Suitable electrical conductors, not shown, are connected to the motor 216, and extend through the housing means 62 to the cab 23. Conventional controls are provides in the cab 23 for controlling the operation of the motor 216.

The motor 216 has a housing with an endplate 220 which is fixed to the shaft 206. The gearbox 218 is in turn supported from the motor 216. The bucket wall actuation system 204 is supported from the exterior of the housing of the motor 216, as shown.

The motor 216 is operatively connected to the gearbox 218. The gearbox 218 is conventional in design and provides a speed reducing function for the output of the motor 216. A planetary gear provides the output from the gearbox 218 and this planetary, not shown, is coupled to a sleeve 222 coaxial with the shaft 206. The sleeve 222 is in turn connected to the wheel 202. In this manner, the motor 216 drives the gearbox 218 which in turn rotates the sleeve 222, which in turn rotates the wheel 202. Thus, an electrical motor 216 is used to drive the wheel 202.

According to another feature of this embodiment, cooling air is supplied to the motor 216 through the supporting and housing means 62. Conduits, not shown, are provided in the housing means 62 to communicate with the hollow interior of shaft 206. A blower can be provided to force air through the conduits and into the hollow interior of the housing means 62. As can be seen in FIG. 7, the interior of the housing means 62 communicates with the hollow interior of the shafts 206 to carry air to the interior of the wheel 202. The arrows 224 represent the flow of cooling air into the interior of the wheel 202. As can be seen, the hollow interior of the shaft 206 supplies air into the interior of the gearbox 218 and motor 216. The air can flow through the motor 216 and be exhausted into the interior of the wheel 202. Thus, an embodiment for using an electric motor to power the excavating wheel 202 is disclosed with cooling air flow.

From the foregoing, it will be understood that the present invention comprises additional improvements relating to excavating and loading systems disclosed and claimed in copending application, Ser. No. 435,296, filed Jan. 21, 1974, now U.S. Pat. No. 3,896,571.

Thus, in accordance with the invention described herein, an excavating and loading system comprising a vehicle having an excavating wheel assembly supported on the front thereof is provided for excavating the material and transferring the material to a main conveyor whereupon the material is conveyed to the rear of the vehicle. The excavating wheel itself is inclined at an angle to form an excavation width wider than the following portion of the vehicle. In this manner, this configuration allows the vehicle to be supported and travel through the excavation as it is formed.

This arrangement also increases the width of the excavation formed by a particular system and permits operation of the excavating and loading system within the excavation that is being formed. This materially reduces the amount of movement of the excavating wheel assembly necessary to position the assembly for excavation and travel and thereby reduces the overall complexity of the excavating and loading system incorporating the present invention.

It is to be understood, of course, by those of ordinary skill in the art, that although the vehicle is illustrated with track type wheels, conventional tired wheels could be utilized. In addition, the system is shown as utilizing an internal combustion engine with hydraulic pumps and motors to operate various elements of the system. It is envisioned that an internal combustion engine could be used with electric generators and motors to operate the various elements of the system without departing from the present invention.

It is also envisioned that suitable apparatus could be mounted on the front of the vehicle 22 to provide pitch and roll adjustment for the excavating wheel assembly 60. This apparatus could simultaneously move the conveyor 142, chute 160 and moldboard assembly 132 as a unit with the excavating wheel assembly 60 to minimize clearance between these elements and reduce spillage.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitution of parts and elements without departing from the spirit and scope of the invention as defined in the appended claims.

What is claimed is:

1. An excavating and loading system comprising in combination:

a vehicle including a frame and means supporting the frame of the vehicle for movement over a surface;

excavating wheel means for forming an excavation and including opposed end plates and a plurality of digging buckets extending substantially continuously between the end plates and located immediately adjacent one another to define the entire circumference of the excavating wheel, each digging bucket having a cutting edge which extends to a stationary wall and a wall mounted for pivotal movement from a material receiving position to a material dumping position, said excavating wheel means being wider than the vehicle;

supporting and housing means on the vehicle supporting from the frame and supporting said excavating wheel means cantilever in the front of the vehicle for rotation about an axis extending at an acute angle with respect to the direction of travel of the system, the supporting and housing means engaging the excavating wheel means adjacent one of the end plates thereof;

a plurality of digging teeth mounted on the opposite end plate of the excavating wheel means;

means for selectively varying the relative vertical positioning of said excavating wheel means with respect to said frame whereby said excavating wheel means can be selectively raised or lowered to excavate at various depths;

drive means for rotating the excavating wheel means so that the digging buckets follow a circular path;

said one end plate and said opposite end plate of the excavating wheel means therefore defining circular paths including a forward portion and a rearward portion, respectively, positioned farther apart than the maximum width of the remainder of the excavating and loading system whereby the system is adapted to travel in its own excavation;

means located within the margins of the excavating wheel means and responsive to rotation thereof for positively positioning the movable wall of each digging bucket in the material dumping position when the bucket is in the upper and rearward portion of the path; and conveyor means mounted on the vehicle entirely behind the excavating wheel means for movement around a course including a relatively low portion positioned to receive material from the digging buckets of the excavating wheel means and a relatively high material dumping portion located rearwardly on the vehicle.

2. The excavating and loading system of claim 1 wherein said excavating wheel means in cylindrical and is rotated about its axis, and wherein the supporting and housing means includes shaft means extending into the excavating wheel means and defining said axis.

3. The excavating and loading system of claim 1 wherein the drive means includes motor means mounted within the excavating wheel means for rotating the excavating wheel means, and power supply means extending through the supporting and housing means to the motor means.

4. The excavating and loading system of claim 1 wherein the bucket wall positioning means functions to positively pivot the movable walls of each digging bucket to the material dumping position during the first portion of the rotation of the excavating wheel means and to positively pivot the movable wall to the material receiving position during a subsequent portion.

5. The excavating and loading system of claim 1 wherein said supporting and housing means is positioned entirely behind said wheel means.

6. An excavating and loading system comprising in combination:

a vehicle;

means supporting the vehicle for movement over a surface;

excavating wheel means for forming an excavation including opposed end plates and a plurality of digging buckets each having a cutting edge which extends to a stationary wall and a wall mounted for pivotal movement from a material receiving position to a material dumping position;

means extending from said vehicle for supporting the excavating wheel means on the vehicle whereby the excavating wheel means is positioned in the front of the vehicle for rotating about an axis extending at an acute angle with respect to the direction of travel of the system;

said supporting means having a portion engaging said excavating wheel means adjacent one and plate thereof;

a plurality of digging teeth mounted on the opposite end plate of the excavating wheel means;

means for selectively varying the relative vertical positioning of said excavating wheel means and said vehicle whereby said excavating wheel means can be selectively raised or lowered to excavate at various depths;

drive means for rotating the excavating wheel means so that the digging buckets follow a circular path;

said one end plate and said opposite end plate of the excavating wheel means therefore defining circular paths including a forward portion an a rearward portion, respectively, positioned farther apart than the maximum width of the remainder of the excavating and loading system whereby the system is adapted to travel in its own excavation;

means located within the margins of the excavating wheel means and responsive to rotation thereof for positively positioning a movable wall and a material dumping position when the bucket is in the upper and rearward portion of the path;

conveyor means mounted on the vehicle entirely behind the excavating wheel assembly for movement around a course including a relatively low portion positioned to receive material from the digging buckets of the excavating wheel means and a relatively high discharge position located rearwardly on the vehicle.

7. The excavating and loading system of claim 6 wherein said excavating wheel means is cylindrical and is rotated about its axis, and wherein the supporting and housing means includes axle means extending into the excavating wheel means and defining said axis.

8. The excavating and loading system of claim 6 wherein the drive means includes motor means mounted within the excavating wheel means for rotating the excavating wheel means, and power supply means extending through the supporting and housing means to the motor means.

9. The excavating and loading system of claim 6 wherein the bucket wall positioning means functions to positively pivot the movable wall of each digging bucket to the material dumping position during a first portion of the rotation of the excavating wheel means and to positively pivot the movable wall to the material receiving position during a subsequent portion.

10. In an excavating and loading system having a combination a vehicle, a main frame on the vehicle, means supporting the main frame of the vehicle for movement over a surface, excavating wheel means for forming an excavation and including opposed end plates and a plurality of digging buckets located immediately adjacent one another to define the entire circumferences on the excavating wheel and each having a cutting edge which extends to a stationary wall and a movable wall mounted for pivotal movement from a material receiving position to a material dumping position, supporting and housing means rotatably supporting the excavating wheel means from the frame whereby the excavating wheel means is positioned in front of the vehicle, means for selectively varying the ralative vertical positioning of the excavating wheel means with respect to the frame whereby the excavating wheel means can be selectively raised or lowered to excavate at various depths, drive means for rotating the excavating wheel means of that the digging buckets follow a circular path, means located within the margins of the excavating wheel means and responsive to rotation thereof for positively positioning the movable wall of each digging bucket in the material dumping position when the bucket is in the upper and rearward portion of the path, conveyor means mounted on the vehicle entirely behind the excavating wheel assembly for movement around a course including a relatively low portion positioned to receive material from the digging buckets of the excavating wheel means and a relatively high material dumping portion located rearwardly on the vehicle;

the improvement which comprises said supporting and housing means mounting excavating wheel for rotation about an axis extending at an acute angle with respect to the direction of travel;

said end plates of the excavating wheel means being positioned by the angular orientation of the axis of rotation of the excavating wheel means to define circular paths of rotation including a forward portion and a rearward portion, respectively, positioned farther apart than the maximum width of the remainder of the excavating and loading system whereby the system is adapted to travel in its own excavation.

11. The excavating and loading system of claim 10 wherein the improvement further comprises digging teeth on the forward facing end of said wheel means.

12. The excavating and loading system of claim 10 wherein the improvement further comprises a portion of said supporting and housing means engaging one end of said wheel means and wherein said portion is positioned entirely behind said wheel means.

13. The excavating and loading system of claim 10 where in said excavating wheel means is cylindrical and is rotated about its axis, and wherein the supporting and housing means includes axle means extending into the excavating wheel means and defining said axis.

14. The excavating and loading system of claim 10 wherein the drive means includes motor means mounted within the excavating wheel means for rotating and excavating wheel means, and power supply means extending through the supporting and housing means to the motor means.

15. The excavating and loading system of claim 10 wherein the bucket wall positioning means functions to positively pivot the movable wall of each digging bucket to the material dumping position during a first portion of the rotation of the excavating wheel means and to positively pivot the movable wall to the material receiving position during the subsequent portion.

16. An excavating and loading system comprising:

a vehicle including a main frame and means supporting the main frame for movement over a surface;

excavating wheel means including opposed end plates and a plurality of digging buckets each extending continuously between the end plates, said digging buckets being positioned immediately adjacent one another around the entire circumfernece of the excavating wheel means;

each of the digging buckets of the excavating wheel means comprising a stationary wall and a movable wall mounted for pivotal movement between material receiving positions and material dumping positions;

means supporting the excavating wheel means for rotation about a substantially horizontally disposed axis extending angularly relative to the path of travel of the vehicle;

the angular orientation of the axis of rotation of the excavating wheel means defining circular paths of rotation of the end plates of the excavating wheel means wherein the path of rotation of one of the end plates has a laterally extending forward portion and the path of rotation of the opposite end plate has a laterally extending rearward portion;

the laterally extending portions of the paths of rotation of the end plates spaced apart farther than the widest portion of the remainder of the excavating system so that the excavating system is adapted to travel in its own excavation;

means responsive to rotation of the excavating wheel means for positively pivoting the movable wall of each digging bucket to the material dumping position;

an arm extending forwardly from the frame of the vehicle on the side thereof corresponding to the end plate of the excavating wheel means having the path of rotation including the laterally extending forward portion;

means rotatably supporting the excavating wheel means cantilever on the arm;

means for selectively pivoting the arm about a substantially horizontally disposed axis extending substantially parallel to the axis of rotation of the excavating wheel means and thereby varying the vertical positioning of the excavating wheel means relative to the frame of the vehicle and thereby effecting a change in the grade of the excavation; and conveyor means mounted on the vehicle entirely behind the excavating wheel means for receiving material excavated thereby and for transporting the material upwardly and rearwardly on the vehicle.

17. The excavating and loading system of claim 16 wherein the improvement further comprises digging teeth on the end of said excavating wheel means remote from said arm.

18. The excavating and loading system of claim 16 further including axle means extending into the excavating wheel means from said arm and defining said axis of rotation of the excavating wheel means.

19. The excavating and loading system of claim 16 wherein the drive means includes motor means mounted within the excavating wheel means for rotating and excavating wheel means, and power supply means extending through the arm to the motor means.

20. The excavating and loading system of claim 16 wherein the bucket wall pivoting means functions to positively pivot the movable wall of each digging bucket to the material dumping position during a first portion of the rotation of the excavating wheel means and to positively pivot the movable wall to the material receiving position during the subsequent portion.

* * * * *